US006343394B1

(12) United States Patent
Gandolfi

(10) Patent No.: US 6,343,394 B1
(45) Date of Patent: Feb. 5, 2002

(54) MATTRESS WITH INTERACTIVE ELASTIC ELEMENTS

(75) Inventor: Stefano Gandolfi, Verona (IT)

(73) Assignee: Esperides S.r.l., Lauzacco di Pavia di Udine (IT)

( * ) Notice: Subject to any disclaimer, the term of this patent is extended or adjusted under 35 U.S.C. 154(b) by 5 days.

(21) Appl. No.: 09/476,112

(22) Filed: Jan. 3, 2000

(51) Int. Cl.[7] ..... A47C 27/00
(52) U.S. Cl. ..... 5/690; 5/719
(58) Field of Search ..... 5/690, 719, 724, 5/727

(56) References Cited

U.S. PATENT DOCUMENTS 5,044,027 A 9/1991 Moon ..... 5/690

FOREIGN PATENT DOCUMENTS

DE 29 42 174 4/1981 ..... 5/719
DE 91 12 825 12/1992
GB 2 028 967 3/1980
GB 2 207 045 1/1989

*Primary Examiner*—Alexander Grosz
(74) *Attorney, Agent, or Firm*—Oblon, Spivak, McClelland, Maier & Neustadt, P.C.

(57) ABSTRACT

A mattress (10) with interactive elastic elements, comprising a number of hollow polyhedrons (11) with an octagonal base, made of an elastic and/or yielding material, arranged in longitudinal rows (12), interconnected and held in position within each row (12) by linings (30) made of a textile material enclosing the individual rows (12) of polyhedrons (11) or by guide bars (13) attaching to them by coupling devices (14) arranged on two lateral faces (15) opposing each other. Under the weight of an outstretched body (30) on the surface (21) of the mattress (10), each elastic polyhedron (11) compresses while bulging out transversally and exerting a pressure on the adjacent elastic elements (11), thus expanding them in length.

18 Claims, 5 Drawing Sheets

MATTRESS WITH INTERACTIVE ELASTIC ELEMENTS

BACKGROUND OF THE INVENTION

1. Field of the Invention

This invention relates to a mattress with interactive elastic elements.

2. Discussion of the Background

The evolution of the human species, marked by an upright posture, has led the spinal column to develop in a particular S-shaped form.

This is on one hand optimal for the functionality of its movements and the load distribution it must sustain, but renders it on the other hand particularly vulnerable to painful afflictions (lumbar and cervical arthroses, dorsalgia, lumbalgia, lumbar sciatalgia, discal hernia, kyphosis, scoliosis etc.).

In order to avoid favoring such afflictions and possibly to forestall them, it is fundamental to have mattresses capable of allowing the spinal column to maintain the same configuration, even in an outstretched position, that it exhibits in an upright posture.

The mattresses lacking such characteristics in fact compel the spinal column to assume irregular positions, thus contributing to increase the painful afflictions and consequently the automatic stiffening of the muscles in a vain attempt to properly reposition the spinal column. Moreover, it is essential that the mattress allow a healthy air circulation, so as to optimize the body's transpiration and prevent the stagnation of humidity; it would further be desirable if the mattress lining could at the same time be removed so as to be laundered and disinfected in a dry fashion or in a washing machine, thus ensuring the maintenance of a top hygienic condition guarding it against mites, bacteria, mold and dusts, a frequent source of allergic and infective diseases.

Various types of mattresses are currently on the market. A first type is represented by mattresses traditionally stuffed with wool or other plant or animal fibers, which are more or less thermally insulating and generally poorly transpiring, depending on the stuffing material used.

These mattresses quickly assume the shape of the body resting on them, and consequently require constant and frequent re-carding to ensure proper support. These mattresses are also lacking from a hygienic viewpoint, as they cannot be unlined.

A second type of mattresses is represented by the springy kind, with either interconnected or independently acting springs.

The mattresses with interconnected springs are generally produced by the so-called "bonnell system", which is in itself highly economical to produce, yet of a technically poor design, as it provides a barely satisfactory support, tending to create a hammock-like effect under the body's weight.

A variation of this type of mattress is represented by the mattresses fitted with independent springs, which are often enshrouded in individual bags.

This type of mattress is generally more expensive to produce than the interconnected springs type, but is considerably better because of differentiated support in relation to the weight of the body's various anatomical masses.

In general, however, even the springy mattresses of this type are inadequate from a hygienic viewpoint, as they cannot be unlined.

The current market also offers mattresses based on lattice or expanded material, consisting in slabs of lattice or expanded material sheathed in linings made of natural or synthetic fabric, often quilted in a non-allergenic material, wool, cotton, or other plant fibers.

Such linings are generally unlineable and therefore capable of ensuring a perfectly hygienic condition, if laundered frequently.

Such linings are generally unlineable and therefore capable of ensuring a perfectly hygienic condition, if laundered at frequent intervals.

The slabs may have a homogeneous or differentiated stiffness, depending on the type of processing they're subjected to; in case of a differentiated stiffness the mattress reacts in a differential manner to the weight of the various anatomical masses, by cushioning even the most voluminous parts, such as the pelvis and shoulders, and supporting those in need of greater support, such as the lumbar vertebrae.

However, this support is not self-regulating with respect to the body weights and configurations not considered in the designing stage; in summary, such a mattress could not prove effective if used by exceedingly heavy or light persons, because it would be unable to interact with the weight and configuration of the outstretched body.

There are finally water mattresses, which are essentially constituted of a container made of an impermeable material containing water; such a mattress may be divided into several chambers, in an interconnected or independent manner. A mattress of this type generally offers a good adaptability to the outstretched body but fails to properly support the spinal column, as it also tends to create a hammock effect; moreover, its ability to allow perspiration is nil, its weight is considerable (over 200 kg apiece) and it demands a constant upkeep to keep bacteria and/or mold from proliferating in the fluid.

SUMMARY OF THE INVENTION

The purpose of this invention is therefore to overcome the mentioned shortcomings, and in particular to produce a mattress with interconnected elastic elements, capable of allowing an orthopedically correct support of the spinal column, and the additional ability to achieve an active reaction to the anatomy and weight of an outstretched body.

Another purpose of this invention is to produce a mattress with interactive elastic elements capable of relaxing the muscular system, while at the same time maintaining the body's temperature at an ideal microclimate.

A further purpose of this invention is to offer a mattress with interactive elastic elements capable of preventing and opposing improper positions of the spinal column, and of allowing the latter to maintain the same configuration as in an erect position, regardless of the resting position (prone, supine, or sideways).

An additional purpose of this invention is to provide a mattress with interactive elastic elements capable of maintaining a top hygienic condition, such as to ensure against mites, bacteria, mold and dusts, which are a frequent source of allergic afflictions.

Yet another purpose of this invention is to provide a mattress with interactive elastic elements capable of being produced easily and economically, without employing complex technologies and expensive components.

These and other purposes are achieved within the scope of this invention, by producing a mattress with interactive elastic elements according to claim 1, which is being referred to for brevity.

In an advantageous manner, the mattress according to this invention combines the basic perquisites represented by a proper support for the spinal column, the transpirability and maintenance of top hygienic conditions with the need to achieve an active reaction of the same mattress to the anatomy of an outstretched body, so as to cushion the most voluminous parts, such as hips and shoulders, and at the same time pushing up those calling for more support, such as the back and kidney areas.

This happens independently of the weight of the outstretched person or of the resting position assumed (prone, supine or sideways), so as to allow the spinal column to maintain an orthopedically correct position at any time and under any circumstances.

BRIEF DESCRIPTION OF THE DRAWINGS

The characteristics and advantages of a mattress with interactive elastic elements according to this invention will be more clearly evident from the following description of an embodiment offered for exemplifying and non-limiting purposes, referred to the simplified drawings attached, in which.

DESCRIPTION OF THE PREFERRED EMBODIMENTS

Figure 1:
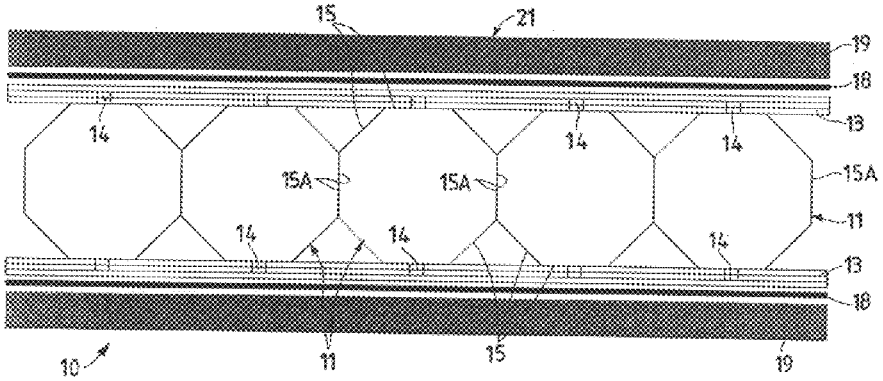
FIG. 1 is a schematic partial view, facing a side, of a mattress with interactive elastic elements, according to this invention.
Figure 2:
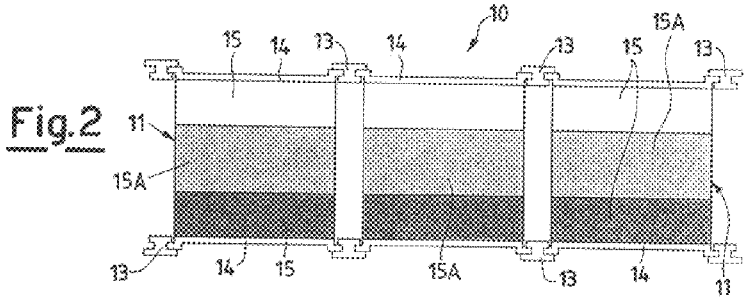
FIG. 2 is a schematic partial view, facing the front, of a mattress with interactive elastic elements, according to this invention.
Figure 3:
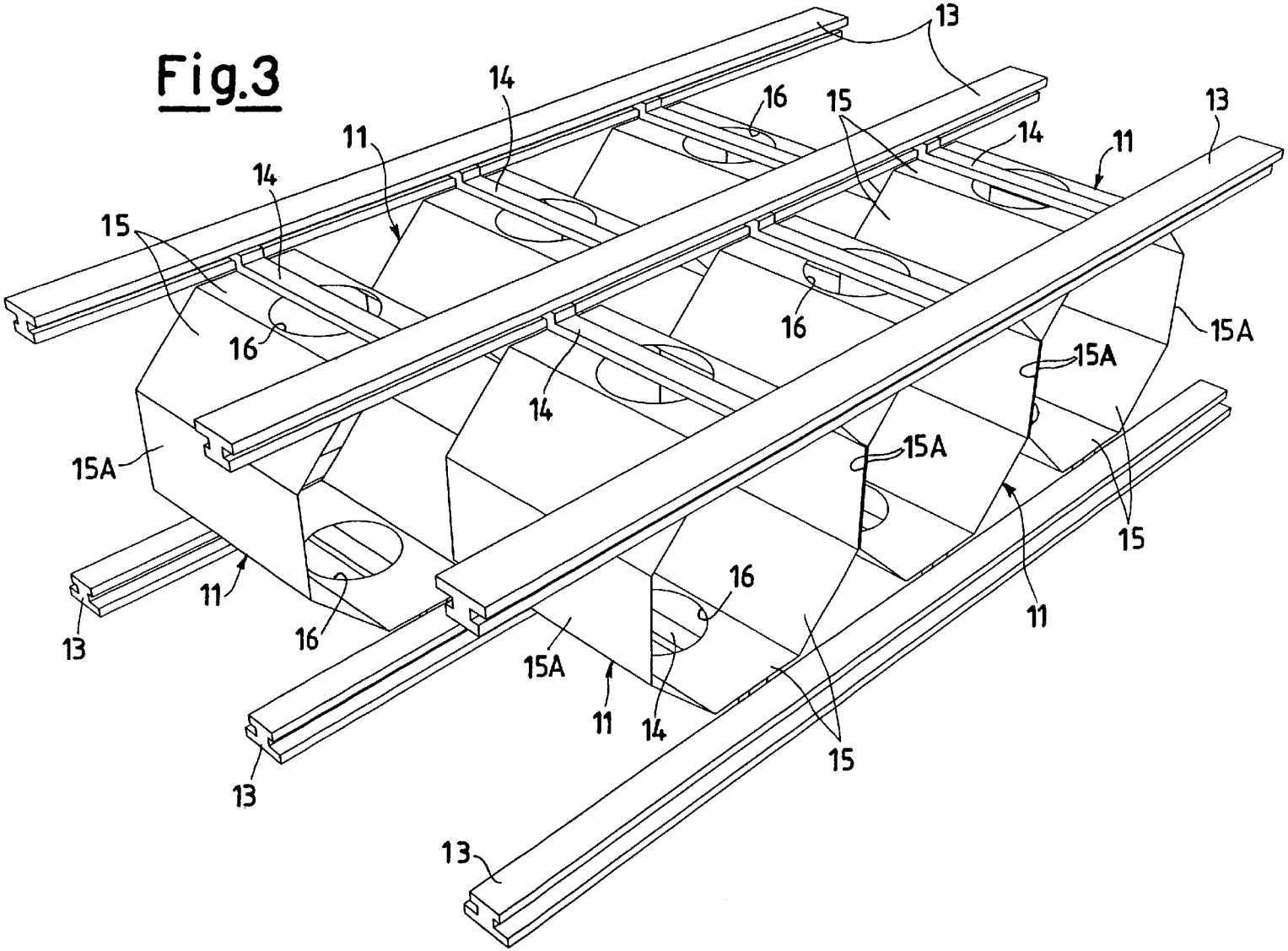
FIG. 3 shows a prospective view of an enlarged portion of a mattress with interactive elastic elements, according to this invention.
Figure 4:
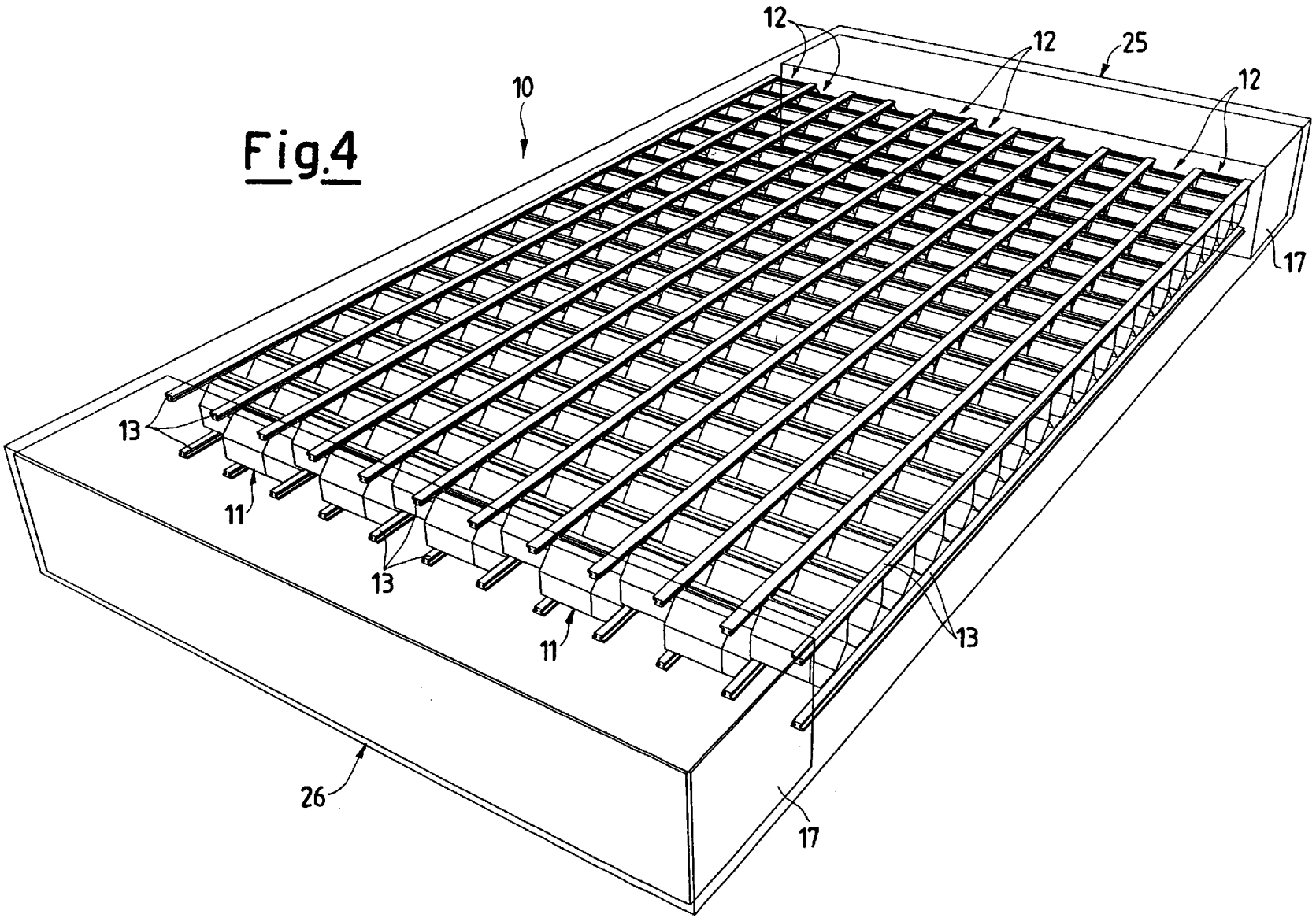
FIG. 4 shows an overall prospective view of a mattress with interactive elastic elements, according to this invention.
Figure 5:
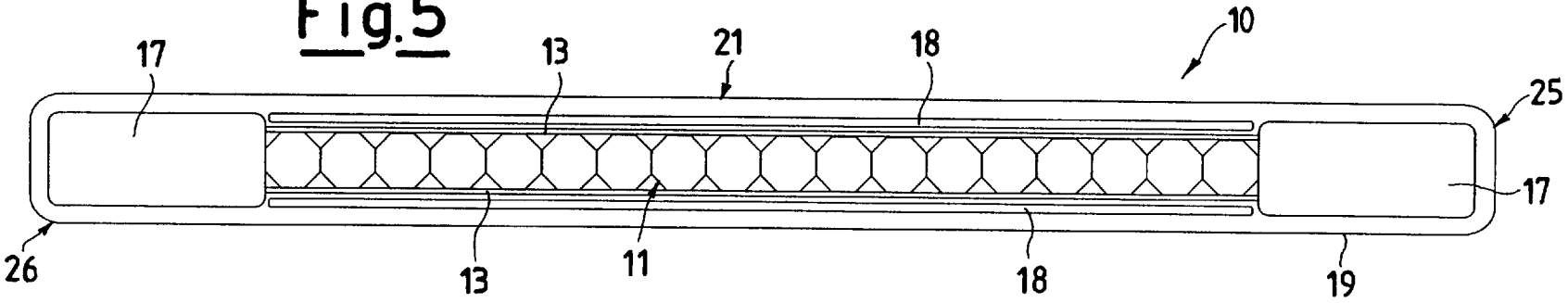
FIG. 5 shows a simplified side view of the mattress with interactive elastic elements shown in FIG. 4, according to this invention, in a resting position.

With reference to the mentioned figures, the number 10 generally indicates a mattress with interactive elastic elements, according to this invention, which includes in its interior a number of elements or hollow polyhedrons 11, in particular with an octagonal base, made of an elastic material and arranged along a number of rows 12 in a longitudinal sense with respect to the rectangular geometric shape of the mattress 10, with their bases facing the larger flanks of the mattress itself.

The individual hollow polyhedrons 11 are interconnected and held in position within each row 12 by parallel guide bars 13, arranged at the top and bottom of the mattress 10, between one polyhedron 11 and the other, whose profile turns out to have the shape of a double C.

Each polyhedron 11 is connected to two parallel guide bars 13, by a coupling device 14 fitting into the C-shaped hollows of every bar 13, and is tied-up to rest against one of the lateral faces 15 of the polyhedron 11; in particular, the structure is such that all elastic polyhedrons 11 are free to move in a lengthwise direction with respect to the mattress 10, as the coupling elements 14 are free to move along the guide bars 13, to which they are attached.

The structure formed by the hollow elastic polyhedrons 11, the guide bars 13 and the coupling elements 14 is constrained at its extremities 25 and 26, which form the lesser sides of the mattress 10, by two parallelepipedon-shaped blocks 17 made of expanded material or a similar material, which serve the function of limiting the transversal shifting of the polyhedrons 11, and returning them to a resting position in the absence of a pressure acting on them.

The mentioned structure is then enclosed within a first lining 18 made of a strong and permeable textile fabric and is finally wrapped, on top of this first lining 18, in a second outer lining 19, which is eventually quilted with wool, cotton or other materials and fitted with a zipper (not shown in the figures), so as to be easily detached to be laundered and disinfected, thus allowing the mattress 10 to stay in a top hygienic condition in time.

The transpirability of the mattress 10 with interactive elastic elements according to this invention is also favored by the fact that the elastic polyhedrons 11 are fitted with round holes 16 on at least two opposing faces (in particular, according to a preferred but not limiting embodiment, on those the coupling elements 14 are resting upon); moreover, their design and operation is such as to produce a healthy air circulation inside the mattress 10, whenever they are activated by the pressure resulting from the motions of an outstretched body 30.

Figure 6:
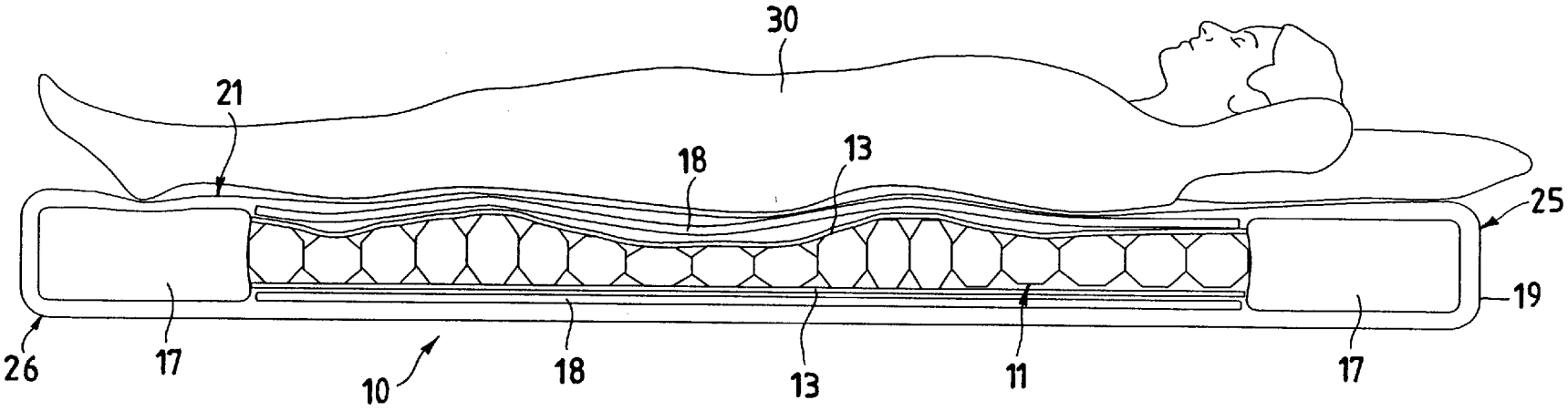
FIG. 6 shows a simplified side view of the mattress with interactive elastic elements shown in FIG. 4, according to this invention, when subjected to the load of an outstretched body.

In effect, the mattress with interactive elastic elements according to this invention functions as follows:

Since the polyhedrons 11 are hollow, of an octagonal shape and made of an elastic and/or yielding material, each of them compresses under the weight of an outstretched body 30, bulging out transversally with respect to the geometric structure of the mattress 10 and exerting a pressure on the adjacent polyhedrons 11, so as to expand them in length in the same longitudinal sense of the mattress 10, as clearly illustrated in FIG. 6.

The octagonal shape of the hollow polyhedrons 11 and their elastic and yielding characteristics work in such a manner that the opposing sides 15A of each element 11 remain under any and all circumstances perpendicular to the plane 21 of the mattress 10, even in a situation where a strong pressure is exerted on the plane 21 by an outstretched body 30; at the same time, the same opposing side faces 15A are under any and all circumstances keeping in contact with the side faces 15A corresponding to the adjacent elastic polyhedron 11, both in a resting position and when a pressure is exerted by an outstreched body 30 on the plane 21 of the mattress 10.

This interactive situation is shown in detail in FIG. 6, which illustrates the motions performed by the elastic polyhedrons 11 under the pressure exerted by a body 30 in a supine position; this allows the mattress 10 to cushion the heaviest and most voluminous parts of the body 30, such as the pelvis an shoulders, while simultaneously pushing up on those calling for support, such as the back and kidney areas.

The freedom to shift enjoyed by each elastic element 11 with respect to the longitudinal direction of the mattress 10 further allows them to stay lined-up with their vertical axis, even if a pressure is made to bear on several adjacent polyhedrons 11.

If subjected to a pressure, as already shown, the hollow polyhedrons 11 are in fact expanding, and if they were unable to longitudinally shift whenever a pressure is brought to bear on several adjacent polyhedrons 11, they would tend to rotate upon themselves, thus compromising the functioning of the entire structure.

Finally, these elastic polyhedrons 11 are also responsible for circulating the air inside the mattress 10, because they actively adapt to the motions of the outstretched body 30 by alternately compressing and expanding, and therefore function like a series of small pumps, with the result of expelling the contaminated circulating air from the interior of the mattress 10 and to introduce a decidedly healthy and hygienically effective recirculation of air. This also prevents the stagnating of humidity and promotes a high degree of hygiene and comfort.

The description provided above outlines the characteristics of a mattress with interactive elastic elements, according to this invention, and clarifies its advantages.

These are in particular composed of:

An "active" kind of support for the spinal column,

An adequate "comfort" for the user,

Good transpiration,

A substantially light-weight overall structure,

Limited costs in relations to the results obtained.

Finally, it is clear that numerous variations may be applied to the mattress with interactive elastic elements according to this invention, without thereby abandoning the innovative principles inherent in the inventive idea, just as it is clear that in the practical implementation of the invention the materials, shapes and sizes of the illustrated details may be of any kind depending on the requirements, and that the same may be substituted with others of a technically equivalent type.

Figure 7:
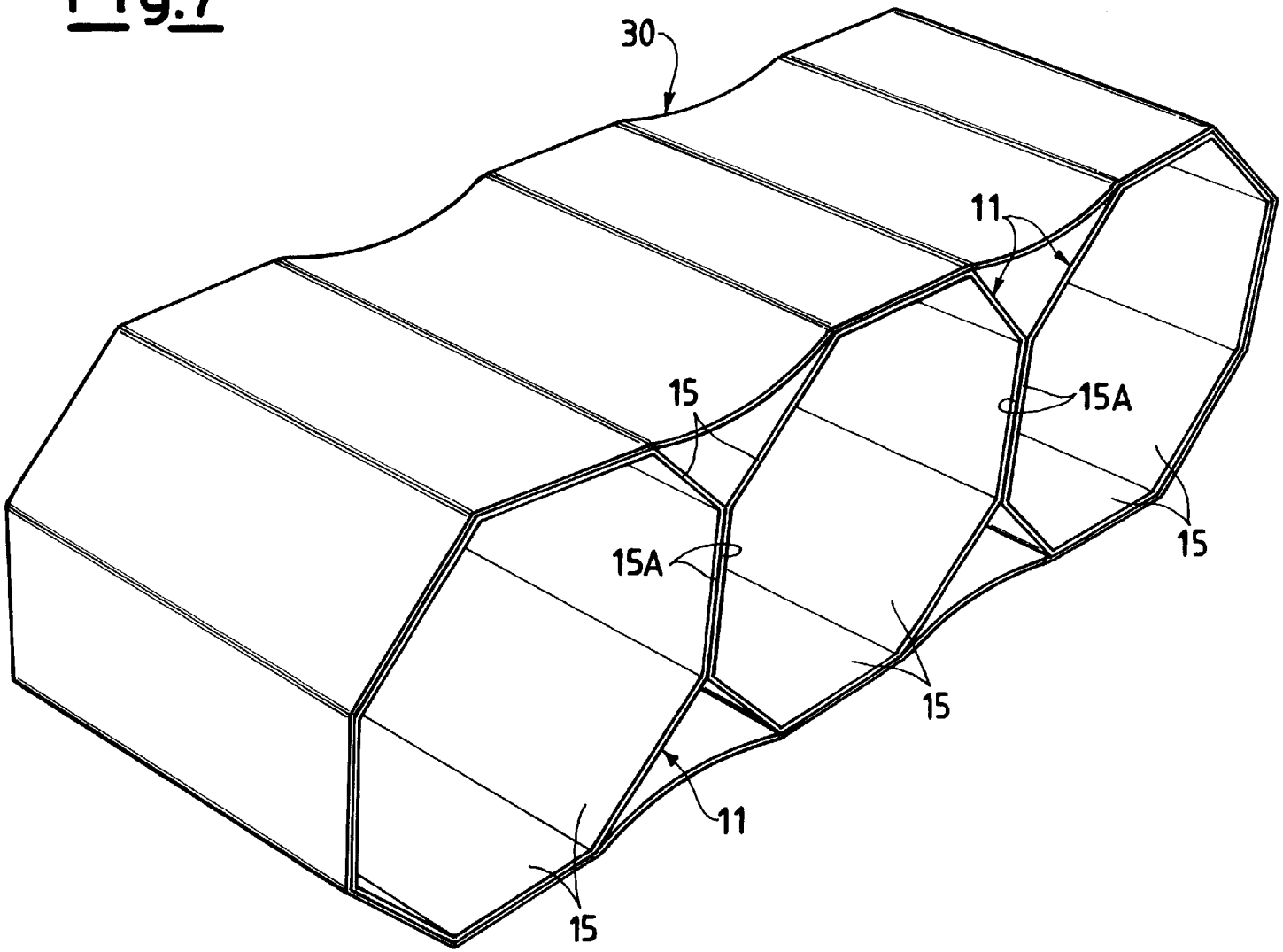
FIG. 7 shows a prospective view of a mattress with interactive elastic elements according to this invention, based on an alternative embodiment with respect to that shown in FIG. 3.

For instance, in alternative embodiments the polyhedrons 11 may also be held in position within each row 12, in addition to the guide bars 13, by a lining 30 made of textile fabric, enshrouding the individual rows 12 of polyhedrons 11 (see FIG. 7).

The polyhedrons 11 can thus shift with respect to their longitudinal axis, by moving inside the mentioned linings 30.

Moreover, the polyhedrons 11 may be kept aligned with respect to their vertical axis, preventing them from rotating with respect to the same, if subjected to a pressure, by seams or thermal welds applied to the lining 30, so as to individually enshroud them inside the same. The individual linings 29 enclosing the longitudinal rows 12 of polyhedrons 11 may also be connected to each other, for example by seams or thermal welds.

What is claimed is:

1. A mattress with interactive elastic elements, comprising a plurality of hollow polyhedrons made of at least one of an elastic material and a yielding material, said hollow polyhedrons being interconnected with each other to form at least one row such that said hollow polyhedrons are each configured to compress when a weight bears on the mattress by bulging out in a horizontal direction with respect to a geometric shape of said mattress and configured to exert a pressure on at least one adjacent hollow polyhedron of said hollow polyhedrons to expand in a vertical direction with respect to the geometric shape of said mattress;

wherein:

said hollow polyhedrons each comprise an octagonal base, said octagonal bases each having at least two opposing lateral surfaces perpendicular to a horizontal plane of said mattress and said at least two opposing lateral surfaces each maintaining contact with a respective one of said at least two opposing lateral surfaces of adjacent ones of said octagonal bases; and said hollow polyhedrons are arranged in a plurality of longitudinal rows with respect to the geometric shape of said mattress and are held in position within each of said longitudinal rows formed by a plurality of guide bars transversely tied by a plurality of coupling elements positioned on at least one surface of each of said hollow polyhedrons.

2. A mattress with interactive elastic elements according to claim 1, wherein said plurality of guide bars are each profiled in a shape of a double C.

3. A mattress with interactive elastic elements according to claim 1, wherein said octagonal bases are arranged on a horizontal plane with respect to the geometric shape of the mattress.

4. A mattress with interactive elastic elements according to claim 1, wherein said hollow polyhedrons are capable of shifting in a longitudinal direction by sliding along said plurality of guide bars so as to keep aligned with respect to vertical axes of said hollow polyhedrons whenever a pressure is applied on at least two adjacent hollow polyhedrons.

5. A mattress with interactive elastic elements according to claim 1, wherein said hollow polyhedrons arc constrained at two end portions of said mattress by at least two blocks made of an expanded material to limit a length of said at least one row formed of said hollow polyhedrons and return to a resting position which is without any pressure exerted on the mattress.

6. A mattress with interactive elastic elements according to claim 1, wherein said mattress is enclosed in at least one first lining made of a strong and transpiring fabric, and a second outer lining wrapped around said first lining and fitted with a zipper.

7. A mattress with interactive elastic elements according to claim 1, wherein at least one of said at least two opposing lateral surfaces has a hole to generate air circulation within said mattress.

8. A mattress with interactive elastic elements, comprising a plurality of hollow polyhedrons made of at least one of an elastic material and a yielding material, said hollow polyhedrons being interconnected with each other to form at least one row such that said hollow polyhedrons are each configured to compress when a weight bears on the mattress by bulging out in a horizontal direction with respect to a geometric shape of said mattress and configured to exert a pressure on at least one adjacent hollow polyhedron of said hollow polyhedrons to expand in a vertical direction with respect to the geometric shape of said mattress;

wherein:

said hollow polyhedrons each comprise an octagonal base, said octagonal bases each having at least two opposing lateral surfaces perpendicular to a horizontal plane of said mattress and said at least two opposing lateral surfaces each maintaining contact with a respective one of said at least two opposing lateral surfaces of adjacent ones of said octagonal bases; and said hollow polyhedrons are arranged in a plurality of rows in a longitudinal direction whit respect to the geometric shape of said mattress and are kept in position within each of said plurality of rows by a respective one of a plurality of linings, said plurality of linings being each configured to enclose a single row of hollow polyhedrons and being tied to each other by at least one of seams arid thermal welds applied to said plurality of logs.

9. A mattress with interactive elastic elements according to claim 8, wherein said octagonal bases are arranged on a horizontal plane with respect to the geometric shape of the mattress.

10. A mattress with interactive elastic elements according to claim 8, wherein said hollow polyhedrons are constrained at two end portions of said mattress by at least two blocks made of an expanded material to limit a length of said at least one row formed of said hollow polyhedrons and return to a resting position which is without any pressure exerted on the mattress.

11. A mattress with interactive elastic elements according to claim 8, wherein said mattress is enclosed in at least one first lining made of a strong and transpiring fabric, and a second outer lining wrapped around said first lining and fitted with a zipper.

12. A mattress with interactive elastic elements according to claim 8, wherein at least one of said at least two opposing lateral surfaces has a hole to generate air circulation within said mattress.

13. A mattress, comprising:

a plurality of hollow polyhedrons forming at least one longitudinal row positioned horizontally in the mattress, said hollow polyhedrons being configured to interact with each other such that each of said hollow polyhedrons bulges in a longitudinal direction of said at least one longitudinal row when compressed by a force and transfer the force to at least one adjacent one of said hollow polyhedrons to expand vertically;

a plurality of guide bars forming at least one frame for said at least one longitudinal row; and a plurality of coupling elements slidably disposed between said plurality of guide bars, said plurality of coupling elements each being disposed on a respective one of said plurality of hollow polyhedrons.

14. A mattress according to claim 13, wherein said hollow polyhedrons each have at least one hole in one of surface portions.

15. A mattress according to claim 13, further comprising blocking means for limiting longitudinal extension of said at least one longitudinal row.

16. A mattress according to claim 13, wherein said hollow polyhedrons form a plurality of longitudinal rows disposed in parallel.

17. A mattress according to claim 13, wherein said plurality of guide bars are each profiled in a shape of a double C.

18. A mattress according to claim 13, wherein said hollow polyhedrons are capable of shifting in a longitudinal direction by sliding along said plurality of guide bars so as to keep aligned with respect to vertical axes of said hollow polyhedrons whenever a pressure is applied on at least two adjacent hollow polyhedrons.

* * * * *